US005158116A

United States Patent [19]

Kazuo et al.

[11] Patent Number: 5,158,116

[45] Date of Patent: Oct. 27, 1992

[54] APPARATUS FOR VARYING DENT SPACING DURING BEATING UP

[75] Inventors: Morohashi Kazuo; Matsuyama Hiroshi, both of Tokyo, Japan

[73] Assignee: Nippon Oil Company, Limited, Japan

[21] Appl. No.: 741,724

[22] Filed: Aug. 7, 1991

[30] Foreign Application Priority Data

Aug. 8, 1990 [JP] Japan ..... 2-210771

[51] Int. Cl.[5] ..... D03D 49/62

[52] U.S. Cl. ..... 139/192

[58] Field of Search ..... 139/192

[56] References Cited

U.S. PATENT DOCUMENTS 4,458,730 7/1984 Benelli ..... 139/192

FOREIGN PATENT DOCUMENTS 3105149 5/1988 Japan ..... 139/192

556203 6/1977 U.S.S.R. ..... 139/192

*Primary Examiner*—Andrew M. Falik

*Attorney, Agent, or Firm*—Scully, Scott Murphy & Presser

[57] ABSTRACT

A beating apparatus for a thick fabric, comprising a reed supported for advancing and retracting movement, and including a reed frame and a plurality of dents supported by the reed frame for movement toward and away from each other. The beating apparatus also comprises a mechanism engaging the dents to move the dents towards and away from each other, thereby to decrease and increase spacing between the dents, in correlation with advancing and retracting movement, respectively, of the reed.

4 Claims, 3 Drawing Sheets

APPARATUS FOR VARYING DENT SPACING DURING BEATING UP

FIELD OF THE INVENTION

The present invention relates to a beating apparatus for use in weaving a thick fabric of a high fiber density.

PRIOR ART

A thick fabric of a high fiber density usually has a structure wherein unit textile weaves formed using warps and wefts are stacked and connected using pile yarn. FIG. 7 is a plan view showing a weaving state of a thick fabric of this type, in which warps 2 of a thick fabric 1 and pile yarn 3 are arranged laterally in a row on a delivery roller 4 and extend to a cloth fell 6 through a heald 5. The heald 5 is moved up and down in an alternate manner to form a warp shed, then after a weft inserting operation, a reed 7 is moved forward and backward to beat weft to the cloth fell 6. The reed 7 comprises a reed frame and dents fixed at predetermined certain intervals to the read frame.

During weaving, the warps 2 are arranged laterally in a row on the delivery roller 4 and are stacked in plural layers at the cloth fell 6. Therefore, the width of the warps is narrower on the cloth fell side. The degree of the narrowing differs depending on the number of layers and the warp density of the thick fabric to be obtained.

The width of the thick fabric 1 to be obtained and the width of the warps 2 inserted into the reed must be the same. As mentioned above, however, from the delivery roller 4 up to the cloth fell 6, the width of the warps 2 of the thick fabric is reduced, so when the reed 7 moves back by a distance L, the warps 2 are compressed inwards by a distance *l*, so that the warp-dent contact angle becomes larger and due to rubbing of the two the warps becomes fluffy and are broken. There also arises the problem that the dents are damaged by rubbing with the warps and hence the service life thereof becomes shorter. Such a phenomenon is apt to occur at both end portions of the warps 2 where the contact angle is large.

Such problems may be avoided by enlarging the distance between the delivery roller and the cloth fell. In this case, however, not only the weaving machine becomes larger in size but also, in order to ensure an appropriate warp shed width, it is necessary to either enlarge the range of vertical movement of the heald or enlarge the advancing/retreating distance of the reed. But this is troublesome.

It is the object of the present invention to solve the above-mentioned problems and provide a beating apparatus which does not cause fluffing or breaking of warp, has a long service life and is suitable for a thick fabric weaving machine.

SUMMARY OF THE INVENTION

According to the present invention, the foregoing problems are solved by expanding and contracting the interval of dents in interlock with advancing and retreating motions of a reed. More specifically, the beating apparatus of the present invention is provided with a reed comprising a reed frame 13 and dents 17 which are held by the reed frame so that they can move toward and away from each other, and variable members 23, 25, 33, 36 which come into engagement with upper and lower ends of the dents 17 to increase and decrease the spacing between adjacent dents. For those variable members there may be used, for example, a group of slits, an expander, or an elastic string.

In the above apparatus, upon completion of a weft inserting operation, the reed, indicated at 12, which is now in its retracted position for weft inserting, moves forward to the cloth fell side and beats weft to the cloth fell. In this case, the dents 17 which are isolated from each other are brought close to one another by the variable members 23, 25, 33, and 36, and just before beating, the dent interval is restricted to a preset value. In this state there is performed beating, so that the warp density of the thick fabric is maintained at a preset value. When the reed 12 moves back for weft inserting after the beating, the dent width is expanded to the same width of warps by the variable members, and the warp-dent contact angle is maintained approximately equal to that in the beating operation. Thus, the contact angle of the two is maintained nearly constant irrespectively of advancing and retracting motions of the reed, so there does not occur fluffing or breaking of warp.

The present invention will be described in detail hereinunder with reference to the accompanying drawings.

DETAILED DESCRIPTION OF THE PREFERRED EMBODIMENTS

Figure 1:
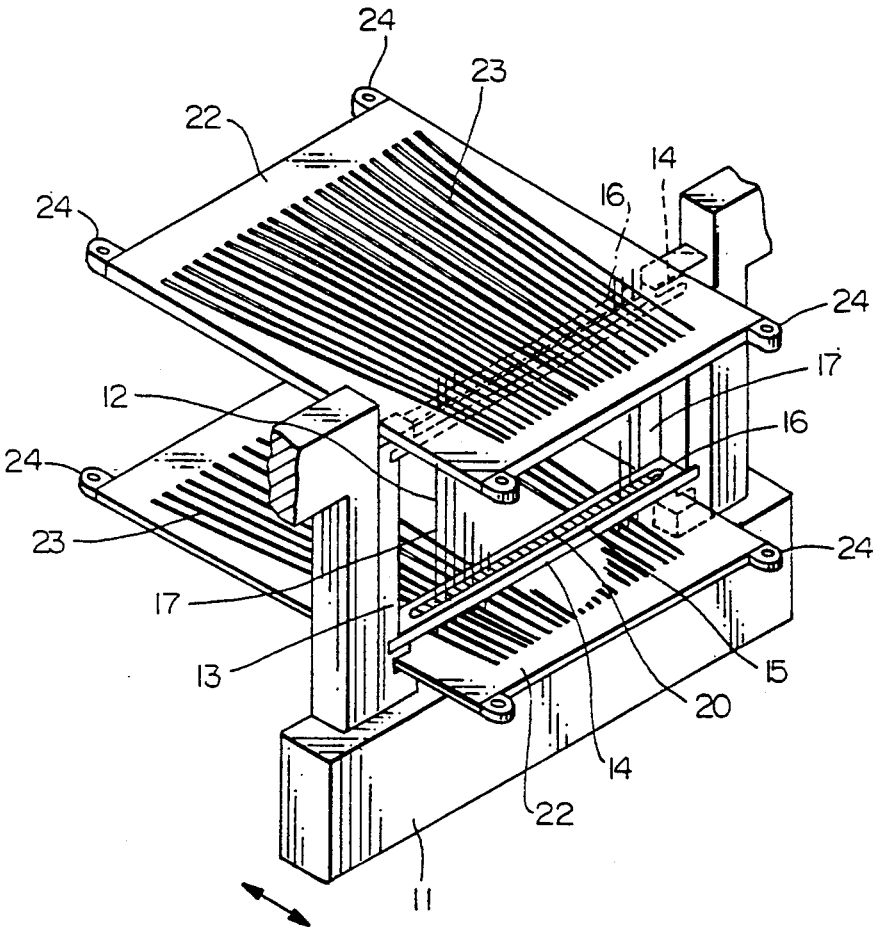
FIG. 1 is a perspective view showing a fabric beating apparatus embodying the present invention.
Figure 2:
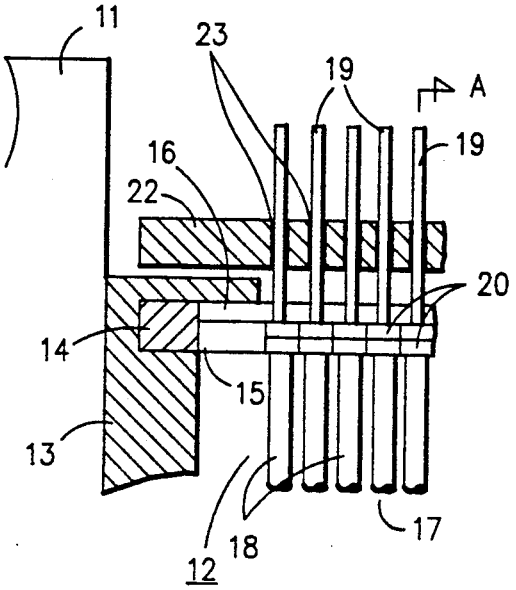
FIG. 2 is a longitudinal sectional view through a portion of the apparatus of FIG. 1.
Figure 3:
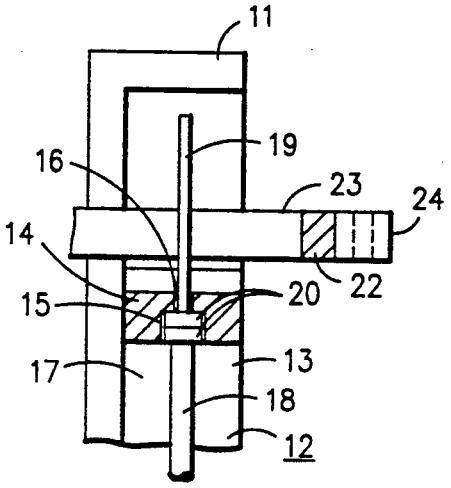
FIG. 3 is a sectional view of the portion of the beating apparatus designated at A in FIG. 2.

FIGS. 1 to 4 illustrate an embodiment of the present invention, of which FIG. 1 is an entire perspective view, and FIG. 2 and 3 are each an enlarged sectional view of a principal portion. In the figures, the numeral 11 denotes a sley; numeral 12 denotes a reed fixed to the sley 11; numeral 13 denotes a reed frame of the reed 12; numeral 14 represents each of upper and lower cross beams of the reed frame 13; numeral 15 denotes a recess formed in an inside surface of each cross beam 14; numeral 16 denotes a through slot formed in the bottom of the recess 15; and numeral 17 denotes a dent which is a rod of a circular section comprising a large-diameter portion 18 and small-diameter portions 19 formed at both upper and lower ends of the large-diameter portion. Numeral 20 denotes a miniature bearing mounted in the connection between the large-diameter portion 18 and each small-diameter portion 19. The dents 17 are each mounted to the reed frame 13 with the miniature bearing 20 being loosely fitted in the recess 15 of the cross beam and each small-diameter portion 19 inserted through the through slot 16. The dents 17 can move toward and away from each other along the cross beams 14.

Numeral 22 represents each of upper and lower guide plates of a rectangular shape disposed in parallel with each other; numeral 23 represents a group of slits formed in a sectorial shape on the guide plate 22; and numeral 24 denotes a bracket, which is disposed at the four corners of each guide plate 22. The upper guide plate is formed of stainless steel, while the lower guide plate is formed of a transparent acrylic resin. The upper and lower groups of slits are of the same shape. The guide plates 22 are each secured to a stationary member (not shown) through the brackets 24. The small-diameter portions 19 of the dents projecting from the through slots 16 are inserted into the upper and lower groups of slits 23.

Figure 4:
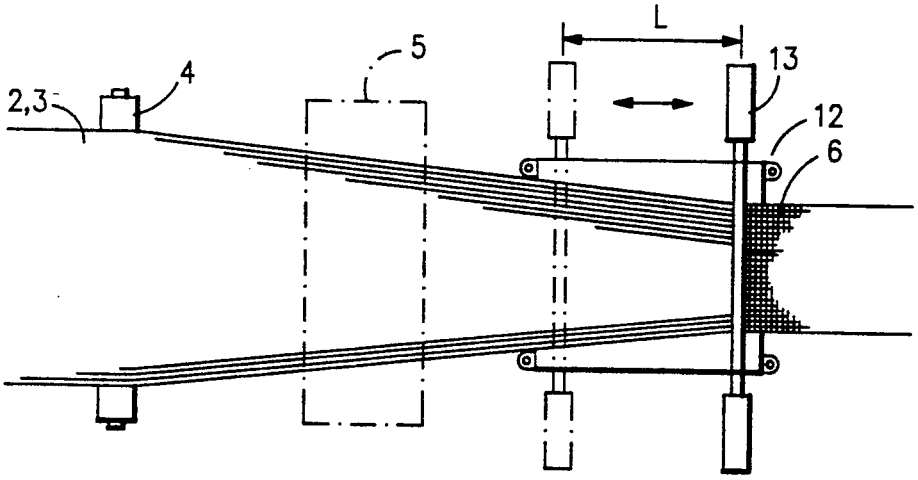
FIG. 4 is a schematic diagram showing the relationship between the beating apparatus and warp.

The beating apparatus of the present invention is fixed to a weaving machine in the following manner. The reed 12 is assembled using miniature bearings 20 of an outside diameter matching a desired warp density, then is fixed to the sley 11, and warps 2 are inserted between dents 17. Slits 23, 25 are selected according to changes in the warp width and the small-diameter portions 19 of the dents projecting from the through slots 16 are inserted into the slits 23, 25, then the guide plates 22 are fixed to the frame of the weaving machine. In the beating apparatus thus fixed, when the reed 12 is in its retracted position for weft inserting, as shown in FIG. 4, the dents 17 wholly expanded with the small-diameter portion 19 being guided by the upper and lower guide plates, and are spaced from each other. When weft inserting is completed and beating is performed, the dents 17 move toward each other while being guided by the slits 23, 25 of the guide plates, and the spacing between adjacent dents is reduced to a desired preset value. Since beating is performed in this state, the warp density of the thick fabric is always kept constant. When the beating is completed and the reed 12 moves back, the small-diameter portions 19 of the dents 17 are guided by the slits 23, 25, causing gradual expansion, and thus the warp-dent contact angle does not change, so the warps neither fluff nor break.

Figure 5:
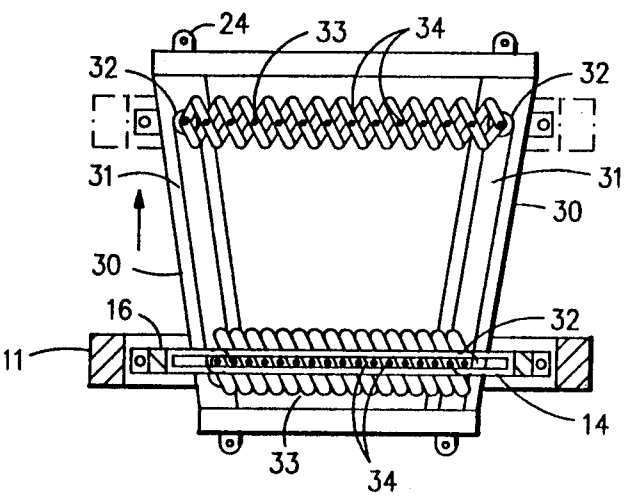
FIG. 5 is a transverse sectional view of a second embodiment of the beating apparatus according to this invention.
Figure 7:
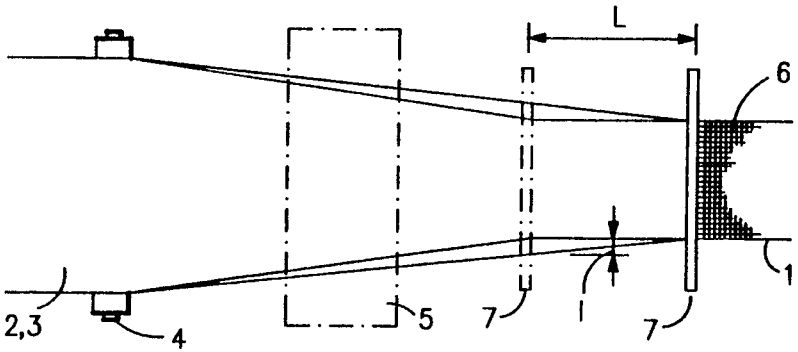
FIG. 7 is a schematic diagram showing a relation between a conventional beating apparatus and warp.

FIG. 5 is a transverse sectional view showing a second embodiment of the present invention. Guide slots 31 are formed in guide rods 30 of upper and lower guide frames which are trapezoidal in plan, and both ends of an expander 33 are connected to rollers 32 fitted loosely in the guide slots 31, then upper and lower ends of dents 17 are mounted to crossing portions 34 of upper and lower such expanders. As the rollers 32 move with backward movement of the reed 12, the expanders 33 expand and the dent spacing also expands. In this embodiment, since the dent expanding structure is simple, it is possible to manufacture the apparatus less expensively.

Figure 6:
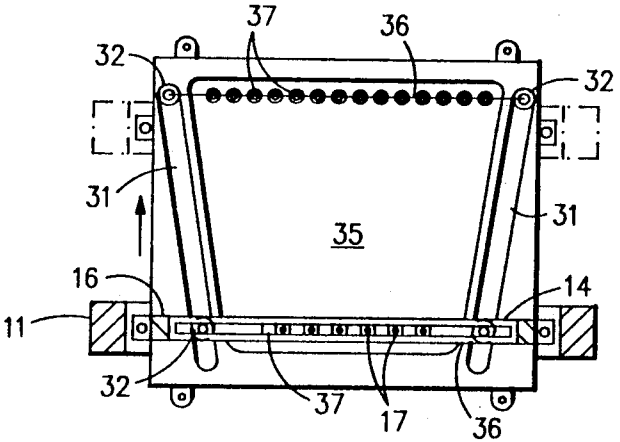
FIG. 6 is a transverse sectional view of a third embodiment of the beating apparatus of this invention.

FIG. 6 illustrates a third embodiment of the present invention. An inverted trapezoid-shaped opening 35 is formed centrally of a rectangular guide plate 22; guide slots 31 are formed along leg sides of the opening; elastic strings 36 are stretched between rollers 32 which are loosely fitted in the guide slots 31; and upper and lower ends of dents are connected at equal intervals to the elastic strings. Numeral 37 denotes a spacer for ensuring the dent spacing. During beating, dents 17 are held at predetermined intervals by the spacers 37, and when the reed 12 moves back, the dents 17 also expand with extension of the elastic string 36.

In the beating apparatus of the present invention, as set forth above, the dent spacing is increased and decreased in interlock with advancing and retracting motions of the reed, so the warp-dent contact angle is kept small irrespective of the reed position and the rubbing force between the two is small, whereby the fluffing and breaking of warps can be prevented.

What is claimed is:

1. A beating apparatus for a fabric, comprising:

a reed supported for advancing and retracting movement, and including i) a reed frame, and ii) a plurality of dents supported by the frame for movement toward and away from each other; and means engaging the dents to move the dents toward and away from each other to increase and decrease spacing between the dents in correlation with advancing and retracting movement, respectively, of the reed.

2. Apparatus according to claim 1, wherein: the means engaging the dents comprises a guide plate forming a plurality of elongated slits, each of the slits having first and second opposite ends, the first ends of the slits are uniformly spaced apart a first given distance, and the second ends of the slits are uniformly spaced apart a second given distance, greater than said first given distance;

each of the dents extends through a respective one of the slits for movement therealong; and as the reed advances and retracts, the dents move along the slits and the slits force the dents toward and away from each other respectively.

3. Apparatus according to claim 1, wherein:

the means engaging the dents includes i) a guide plate having first and second guide slots extending rearwardly laterally away from each other, ii) first and second rollers disposed, respectively, in the first and second guide slots for movement therealong, and iii) an expander connected to the first and second rollers for movement therewith along the guide slots, the expander including a plurality of sections that move toward and away from each other as the expander moves along the guide slots;

each of the dents engages a respective one section of the expander; and as the reed advances and retracts and the dents move with the reed frame, the expander advances and retracts along the guide slots and the expander forces the dents toward and away from each other respectively.

4. Apparatus according to claim 1, wherein: the means engaging the dents includes i) a guide plate having first and second guide slots extending rearwardly laterally away from each other, ii) first and second rollers disposed, respectively, in the first and second guide slots for movement therealong, and iii) an elastic member engaging the first and second rollers for movement therewith along the guide slots, wherein as the rollers move the elastic member along the guide slots, the elastic member expands and contracts;

each of the dents engages a respective one section of the elastic member; and as the reed advances and retracts and the dents move with the reed, the elastic member moves along the guide slots and the elastic member contracts and expands and moves the dents toward and away from each other respectively.

* * * * *